US005094488A

United States Patent [19]

Boadwine et al.

[11] Patent Number: 5,094,488

[45] Date of Patent: Mar. 10, 1992

[54] DEADBOLT LATCH ASSEMBLY

[75] Inventors: William D. Boadwine, Salem; James M. Marshall, Christiansburg, both of Va.

[73] Assignee: Medeco Security Locks, Inc., Salem, Va.

[21] Appl. No.: 545,742

[22] Filed: Jun. 29, 1990

[51] Int. Cl.[5] ..... E05B 9/02

[52] U.S. Cl. ..... 292/337; 292/DIG. 53

[58] Field of Search ..... 292/337, DIG. 64, DIG. 53; 70/448, 449–451

[56] References Cited

U.S. PATENT DOCUMENTS

| | | | |
|---|---|---|---|
| 2,004,510 | 6/1935 | Schlage | 292/337 |
| 2,327,070 | 8/1943 | Schlage | 292/337 |
| 2,444,819 | 7/1948 | Freysinger | 292/337 |
| 2,983,540 | 5/1961 | Check | 292/337 |
| 3,055,691 | 9/1962 | Kessel | 70/449 |
| 4,381,656 | 5/1983 | Hayakawa | 292/DIG. 53 |
| 4,756,638 | 7/1988 | Neyret | 70/451 |
| 4,871,202 | 10/1989 | Friedrichs et al. | 70/450 |
| 4,974,883 | 12/1990 | Jans | 292/169 |
| 5,039,146 | 8/1991 | Lin | 292/DIG. 60 |

FOREIGN PATENT DOCUMENTS

| | | | |
|---|---|---|---|
| 2198783A | 6/1988 | United Kingdom | 292/144 |

*Primary Examiner*—Renee S. Luebke
*Assistant Examiner*—Darnell M. Boucher
*Attorney, Agent, or Firm*—Rothwell, Figg, Ernst & Kurz

[57] ABSTRACT

A deadbolt latch assembly includes a cylindrical latch housing containing a pair of ear tabs for engagement with either of a rectangular or circular faceplate assembly, depending upon the requirements of the door in which the latch assembly is to be mounted. The rectangular faceplate assembly includes a backing plate for rotary engagement with the ear tube, while the circular faceplate assembly includes a pair of elongated slots for slidably engaging the ear tabs and a groove for accepting a retainer ring which holds the ear tabs in place.

8 Claims, 4 Drawing Sheets

DEADBOLT LATCH ASSEMBLY

BACKGROUND OF THE INVENTION

1. Field of the Invention

This invention relates generally to latch lock assemblies, and more particularly to deadbolt latch housing and faceplate assemblies.

2. Background and Prior Art

Conventionally, deadbolt locks for doors contain a deadbolt latch supported within a cylindrical latch housing which is mounted in a lateral bore of the door and a lock cylinder mounted in a transverse bore in operational coupled relationship with the deadbolt latch. The latch housing is anchored within the door by a faceplate which is fixed to the latch end of the housing, and securely mounted flush with the door edge surface.

In wooden doors, the faceplate is conventionally rectangular and fits within a recess chiseled in the door edge circumscribing the lateral bore. The faceplate is secured to the door edge by a number of screws.

In metal doors, a circular faceplate is conventionally utilized in place of a rectangular faceplate, since it is not possible to chisel a recess in the metal door edge. The circular faceplate may include a plurality of serrations or teeth around its periphery which grab the inner bore surface when hammered flush with the door edge surface.

High security conventional deadbolt locks are usually provided with faceplates permanently fixed to the end of the latch unit. A pair of ear tabs extending perpendicular to the end of the housing are sandwiched between the rectangular faceplate and a backing plate fixed to the faceplate rear surface, while the circular faceplate is crimped around the cylindrical surface of the housing.

Because of the need to use a circular type faceplate in certain doors, both types of deadbolt latch units have had to be produced. At the manufacturing stage, this required the shearing off of the ear tabs on housing units to be provided with the circular faceplates, and subsequent crimping of the circular faceplate to the cylindrical housing. In addition, the housing ear tabs had to be between the rectangular faceplate and the backing plate, and the backing plate subsequently fixed to the rectangular faceplate. Thus, extra manufacturing processes have been required to provide both configurations of deadbolt latch unit, resulting in increased costs.

Additionally, retailers have had to either maintain duplicate inventory to meet potential demand, or where inventory shelf space was restricted, could only stock one half the optimal quantity of each type of deadbolt latch unit.

The conventional latch units also presented a burden to professional locksmiths who have had to carry both faceplate types to installation jobs where the door style is not known in advance.

A prior art attempt at solving the problems noted above provides a throwaway rectangular adapter which bayonets onto a circular faceplate permanently fixed to the latch housing. However, this two-piece faceplate configuration has a shoddy appearance, which causes negative customer impact. In addition, the rectangular adapter piece is not capable of being permanently fixed to the circular faceplate, and thus there exists the possibility of latch misalignment and possible malfunction with continuous use over a period of time.

SUMMARY OF THE INVENTION

The present invention provides a deadbolt latch assembly which overcomes the problems noted above.

The present invention provides a deadbolt latch assembly which allows the use of a rectangular faceplate as well as a circular faceplate, without the need for specialized tools. The invention achieves a reduction in manufacturing steps, and a resultant reduction in cost.

The present invention further provides a deadbolt latch assembly which has a sturdy, solid appearance whether used with a circular or rectangular faceplate configuration.

The advantages of the present invention are realized by providing a door latch kit, comprising a latch unit, including a cylindrical latch housing including attachment means for attaching a faceplate to one end thereof, and a latch supported within said cylindrical latch housing, a rectangular faceplate assembly, including a rectangular faceplate having a planar surface with an opening contoured to the cross sectional shape of said latch, and a backing plate fixed to said rectangular faceplate on a surface opposite said planar surface and having means for rotatably engaging and locking said attachment means in place, and a circular faceplate assembly, including a circular faceplate having a planar surface with an opening contoured to the cross sectional shape of said latch and having means for slidably engaging said attachment means, and retaining means for locking said attachment means in engagement with said circular faceplate, said latch unit being usable with either of said rectangular and circular faceplate assemblies.

BRIEF DESCRIPTION OF THE DRAWINGS

The present invention will become more fully understood from the detailed description given herein below and the accompanying drawings which are given by way of illustration only, and are not limitative of the present invention, and wherein.

DETAILED DESCRIPTION OF THE PREFERRED EMBODIMENTS

Figure 1:
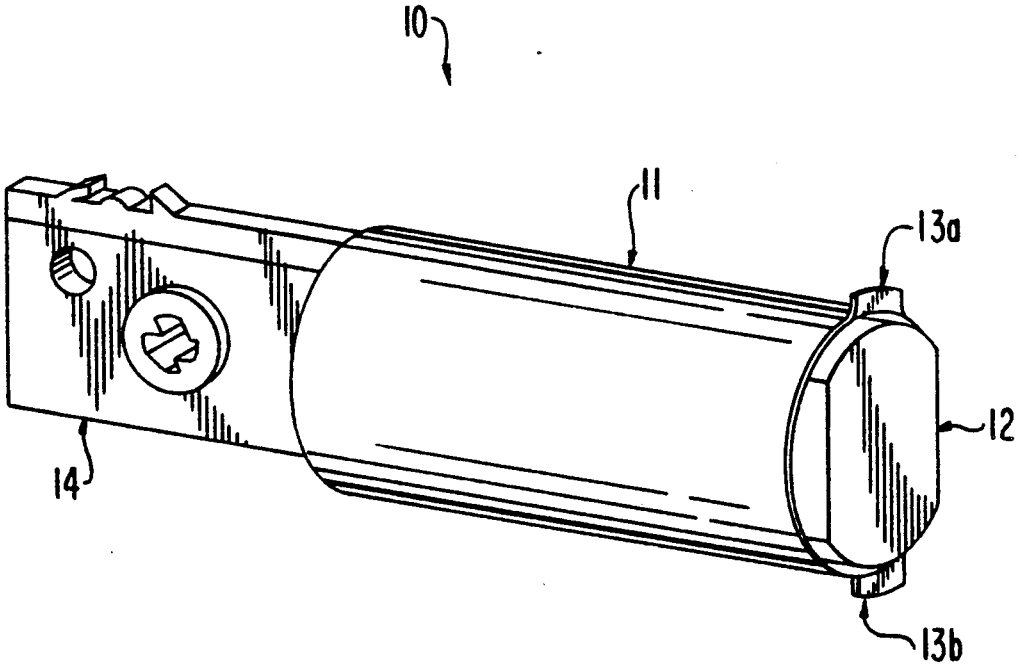
FIG. 1 is a perspective view of a deadbolt latch housing according to one preferred embodiment of the present invention.

FIG. 1 shows a deadbolt latch housing unit 10 having a cylindrical latch housing 11 and a deadbolt latch 12 supported within the cylindrical housing 11. The latch end of cylindrical housing 11 contains a pair of integrally formed ear tabs 13*a*, 13*b* for attachment to a faceplate assembly. Latch operating bar 14 couples with a cylinder lock when mounted in the cross bore of a door and is operated by the cylinder lock to move the deadbolt between a locked and unlocked position.

Figure 2A:
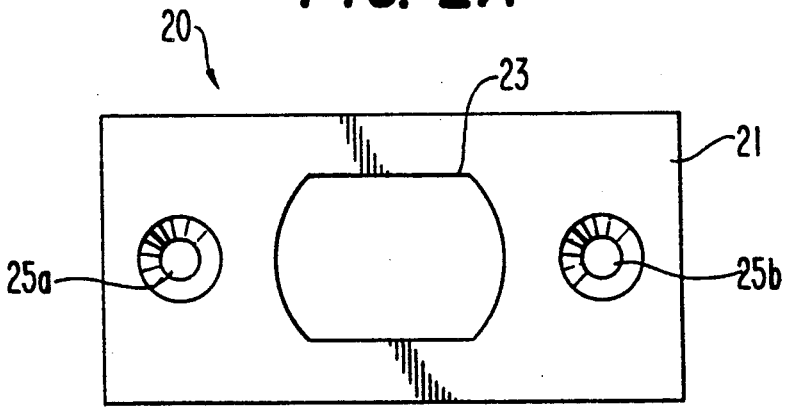
FIGS. 2A–2C are front, side and end views, respectively, of one preferred embodiment of a rectangular faceplate assembly according to the present invention.
Figure 2B:
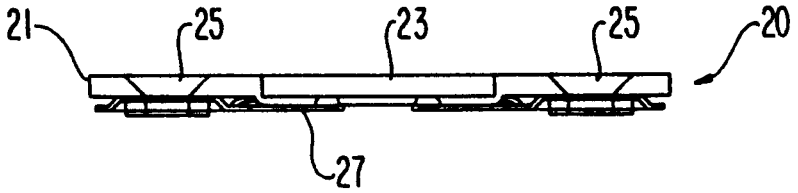
Figure 2C:
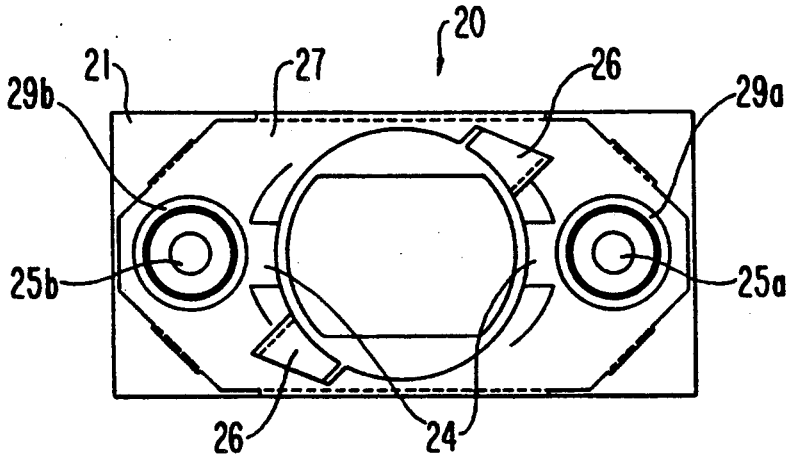

FIGS. 2A–2C illustrate a novel rectangular faceplate assembly 20 according to one preferred embodiment, including a flat rectangular faceplate 21 having a uniform, planar surface containing an opening 23 therein which is contoured to the cross sectional shape of the deadbolt latch 12. Faceplate 21 further contains a pair of tapered holes 25*a*, 25*b* through which the faceplate is secured to the door edge by a pair of mounting screws. When mounted in a door, the faceplate and latch have a solid, sturdy appearance.

Backing plate 27 is fixed to the opposite surface of faceplate 21 by a pair of raised ring notches 29*a*, 29*b* integrally formed with faceplate 21, and includes a pair of raised slots 26 and spring tabs 24. Ear tabs 13*a* and 13*b* are inserted into slots 26 and are rotated and snapped into alignment with spring tabs 24 which clamp and lock the ear tabs in place so that further rotation is not possible. It is noted that the snap engagement between ear tabs 13*a*, 13*b* need not be rotatable for purposes of the invention, but may be linear or any other equivalent type of snap engagement.

Figure 3A:
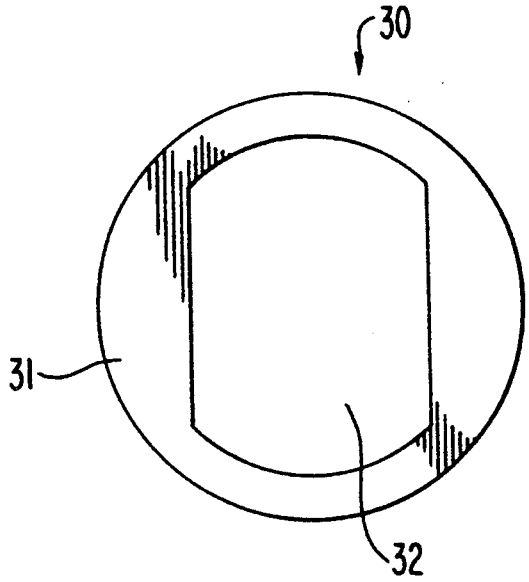
FIGS. 3A–3C are front, side and end views, respectively, of one preferred embodiment of a circular faceplate assembly according to the present invention.
Figure 3B:
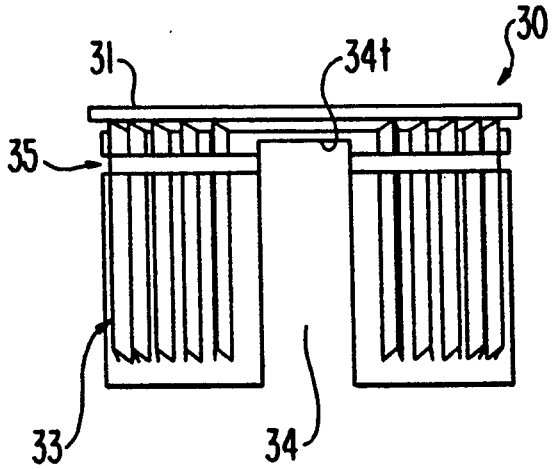
Figure 3C:
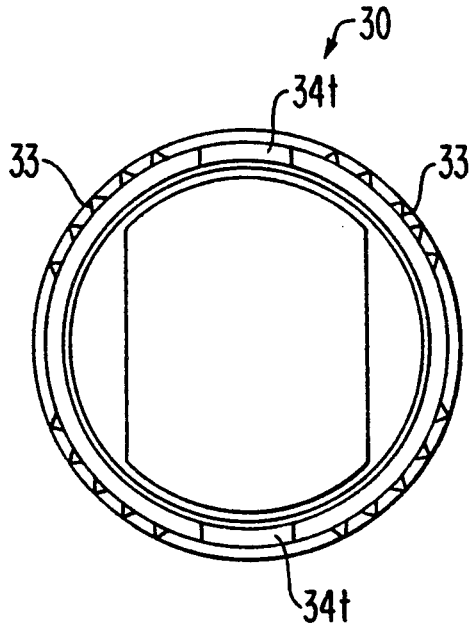

FIGS. 3A–3C illustrate a novel circular faceplate assembly 30 including a flat circular faceplate 31 having a uniform, planar surface with an opening 32 therein contoured to the cross sectional shape of latch 12. Faceplate assembly 30 further includes a plurality of teeth or serrations 33 around the periphery thereof which engage and grip the surface of the bore hole within the door to fix the faceplate and latch unit in place.

Figure 3D:
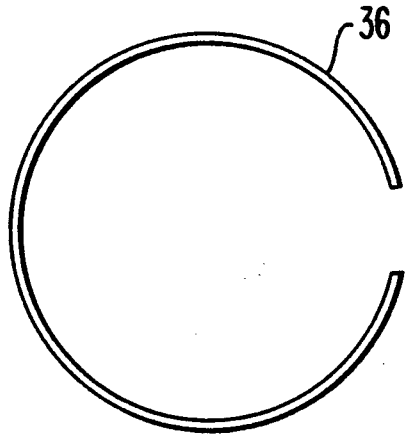
FIG. 3D is a side view of a spring retainer ring utilized with the circular faceplate assembly of FIGS. 3A–3C.

A pair of opposing slots 34 are provided along the sides of assembly 30 which slidably engage ear tabs 13*a* and 13*b* of the cylindrical latch housing 11. A retainer groove 35, provided transverse to slots 34, accepts a spring retainer ring 36 as shown in FIG. 3D. Retainer ring 36 is fitted into groove 35 after ear tabs 13*a* and 13*b* are fully inserted through slots 34 and abut top surface 34*t*, to secure the circular faceplate assembly to the latch housing 11.

The novel latch unit of the present invention is preferably provided as a kit containing the latch housing unit and both the circular and rectangular faceplate assemblies. As such, a locksmith need only carry one latch unit to an installation job without concern for the type of door involved. In addition, the manufacture of latch units is simplified by eliminating the need for separately assembling rectangular and circular faceplate latch units.

While reference has been made to deadbolt latch units for illustration, it is noted that the present invention is not limited to deadbolt configurations but may be applicable to conventional door knob latch units as well.

The invention being thus described, it will be apparent to those skilled in the art that the same may be varied in many ways without departing from the spirit and scope of the invention. Any and all such modifications are intended to be included within the scope of the following claims.

We claim:

1. A door latch kit, comprising:

a latch unit, including a cylindrical latch housing including attachment means for attaching a faceplate to one end thereof, and a latch supported within said cylindrical latch housing;

a rectangular faceplate assembly, including a rectangular faceplate having a planar surface with an opening contoured to the cross sectional shape of said latch, and a backing plate fixed to said rectangular faceplate on a surface opposite said planar surface and having means for snap engaging and locking said attachment means to said rectangular faceplate assembly; and a circular faceplate assembly, including a circular faceplate having a planar surface with an opening contoured to the cross sectional shape of said latch and having means for slidably engaging said attachment means, and retaining means for locking said attachment means in engagement with said circular faceplate;

said latch unit being usable with either of said rectangular and circular faceplate assemblies.

2. A door latch kit according to claim 1, wherein said attachment means comprises a pair of ear tabs integral with and orthogonal to said cylindrical latch housing at said one end thereof, and said retaining means comprises a circular spring retainer ring for insertion into a groove on said circular faceplate for preventing said ear tabs from further movement relative to said circular faceplate.

3. A door latch kit according to claim 1, wherein said means for snap engaging and locking rotatably engages said attachment means.

4. A door latch kit according to claim 1, wherein said latch comprises a deadbolt.

5. A door latch kit according to claim 2, wherein said latch comprises a deadbolt.

6. A circular faceplate assembly for attachment to attachment means of a door latch housing, comprising:

a circular faceplate having a planar surface with an opening contoured to the cross sectional shape of a latch supported within said door latch housing and having means for slidably engaging said door latch housing; and retaining means for locking said door latch housing in engagement with said circular faceplate.

7. A circular faceplate assembly according to claim 6, wherein said door latch housing comprises a pair of ear tabs integral with and orthogonal to said housing at one end thereof, and said retaining means comprises a circular spring retainer ring for insertion into a groove on said circular faceplate for preventing said ear tabs from further movement relative to said circular faceplate.

8. A door latch assembly, comprising:

a latch unit, including a cylindrical latch housing including attachment means for attaching a faceplate to one end thereof, and a latch supported within said cylindrical latch housing; and a circular faceplate assembly, including a circular faceplate having a planar surface with an opening contoured to the cross sectional shape of said latch and having means for slidably engaging said attachment means, and retaining means for locking said attachment means in engagement with said circular faceplate.

* * * * *

UNITED STATES PATENT AND TRADEMARK OFFICE

CERTIFICATE OF CORRECTION

PATENT NO. : 5,094,488

DATED : March 10, 1992

INVENTOR(S) : William D. Boadwine et al.

It is certified that error appears in the above-identified patent and that said Letters Patent is hereby corrected as shown below:

ON THE TITLE PAGE

In the Abstract, line 7, delete "tube", and insert --tabs--.

Column 1, line 45, before "between", insert --secured--.

Signed and Sealed this

Twenty-first Day of September, 1993

Bruce Lehman

*Attest:*

BRUCE LEHMAN

*Attesting Officer*

*Commissioner of Patents and Trademarks*